US010932978B2

(12) United States Patent
Chong

(10) Patent No.: US 10,932,978 B2
(45) Date of Patent: Mar. 2, 2021

(54) COVER FOR A CONTACT ZONE

(71) Applicant: On Chong, Sunnyvale, CA (US)

(72) Inventor: On Chong, Sunnyvale, CA (US)

(73) Assignee: Innova Products, Inc., Sunnyvale, CA (US)

( * ) Notice: Subject to any disclaimer, the term of this patent is extended or adjusted under 35 U.S.C. 154(b) by 329 days.

(21) Appl. No.: 15/229,952

(22) Filed: Aug. 5, 2016

(65) Prior Publication Data

US 2017/0281452 A1 Oct. 5, 2017

Related U.S. Application Data

(60) Provisional application No. 62/314,732, filed on Mar. 29, 2016.

(51) Int. Cl.
*A61H 1/02* (2006.01)

(52) U.S. Cl.
CPC ... *A61H 1/0229* (2013.01); *A61H 2201/1642* (2013.01); *A61H 2203/0493* (2013.01)

(58) Field of Classification Search
CPC ..... A61H 1/0229; A61H 2201/1642; A61H 2203/0493; Y10T 16/533; Y10T 16/5335; E05D 11/0054; E05D 2011/0072; E06B 7/36; E06B 7/362; E06B 7/367
See application file for complete search history.

(56) References Cited

U.S. PATENT DOCUMENTS

| | | | | | |
|---|---|---|---|---|---|
| 2,932,038 | A * | 4/1960 | Sprague | A61H 1/0218 | 5/610 |
| 4,232,662 | A * | 11/1980 | Barber | A61H 1/0218 | 482/144 |
| 4,531,731 | A * | 7/1985 | Law | A61H 1/0218 | 482/144 |
| 6,814,691 | B1 * | 11/2004 | Kuo | A61H 1/0218 | 482/145 |
| 8,012,073 | B2 * | 9/2011 | Barnett | A63B 21/068 | 482/142 |
| 8,056,979 | B2 * | 11/2011 | McBride | A47C 1/02 | 297/326 |
| 8,556,787 | B2 * | 10/2013 | Leier | A61H 1/0222 | 482/144 |
| 2003/0162639 | A1 * | 8/2003 | Hsien | A63B 21/068 | 482/144 |
| 2005/0003935 | A1 * | 1/2005 | Yamauchi | A61H 1/0218 | 482/79 |
| 2014/0274625 | A1 * | 9/2014 | Chen | A61H 1/0229 | 482/144 |
| 2014/0371793 | A1 * | 12/2014 | Steffensmeier | A61H 1/0229 | 606/244 |
| 2018/0338882 | A1 * | 11/2018 | Pena | A61H 1/0292 | |

* cited by examiner

*Primary Examiner* — Peter M. Cuomo
*Assistant Examiner* — Myles A Throop

(57) ABSTRACT

A cover for a contact zone between a rotatable surface and a stop, the cover having a top portion and a front portion. The cover may also include a lateral portion and a back portion to further surround the contact zone. An example of a contact zone may be found on an inversion therapy table, such as inversion therapy tables having a pin and slot adjustment mechanism.

5 Claims, 6 Drawing Sheets

COVER FOR A CONTACT ZONE

This application claims priority to U.S. provisional patent application Ser. No. 62/314,732, filed Mar. 29, 2016 and is hereby incorporated by reference herein.

BACKGROUND

Field of the Invention

Generally, the present invention relates to a cover for a contact zone, such as the contact zone found on an inversion therapy table having a pin and slot adjustment mechanism between the pin and the rotatable surface holding a user.

Description of Related Art

Inversion therapy involves lying flat on your back at an angle or hanging upside down, in head-down position. Inversion therapy tables have a variety of ways to select the maximum inversion angle. One way is a pin and slot mechanism that generally is located on a handlebar of the inversion table. A user of the inversion therapy table places the pin into the desired slot before inverting. The user is held on a rotatable surface of the inversion table. The user may engage in inversion, tilting the rotatable surface. The rotatable surface will continue to allow the user to rotate until a portion of the rotatable surface makes contact with a stop, such as the pin.

Current tables having a rotatable surface, such as an inversion therapy table using a pin and slot mechanism to set the maximum inversion angle, do not have a cover over the contact zone between the rotatable surface and the stop that sets the maximum inversion angle.

The present disclosures address at least some of the issues described above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The embodiments herein provide for a system and apparatus for a cover for a contact zone between a rotatable surface and a stop. The cover may have at least two portions in order to surround, at least in part, the contact zone, such as from the top and front. The cover may further include a lateral portion and a back portion to further surround the contact zone.

An example of a contact zone may be found on an inversion therapy table, such as inversion therapy tables having a pin and slot adjustment mechanism to set the maximum inversion angle. The cover of the present invention may be used to surround, at least in part, the contact zone between the pin and the table's rotatable surface that makes contact with the pin in order to set the maximum inversion angle. The cover may also include an opening to hold the pin. The cover may also include a tab with an opening, which may be used to mount the cover to the inversion therapy table.

Other objectives, advantages, and novel features of the invention will become more apparent from the following detailed description in conjunction with the accompanying drawings.

BRIEF DESCRIPTION OF THE FIGURES

The disclosed subject matter will hereafter be described with reference to the accompanying drawings, wherein like reference numerals denote like elements, and.

Figure 1:
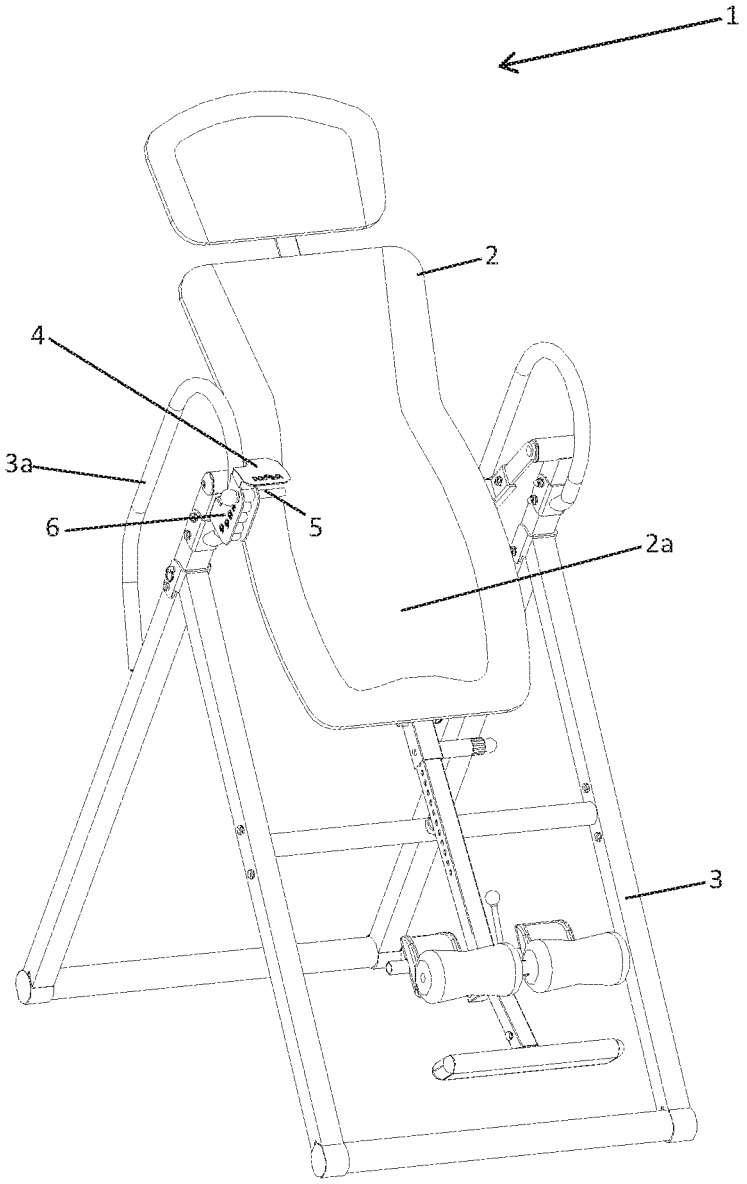
FIG. 1 provides a perspective view of an inversion therapy table having a cover according to the present invention.

While the disclosed subject matter is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DETAILED DESCRIPTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

With reference to FIG. 1, an inversion therapy table (1) having a rotatable surface (2) and a base (3). The rotatable surface (2) may include a backrest (2*a*) as well as a headrest and mechanism to hold a user's feet. The rotatable surface (2) is rotatably connected to the base, typically around the midpoint of the rotatable surface (2). A user of the inversion therapy table (1) is held in place on the rotatable surface while inverting and during inversion therapy. The rotatable surface (2) may invert the user to a maximum inversion angle that is established by a pin (5) and slot (6) mechanism. A cover (4) is also shown.

Figure 2:
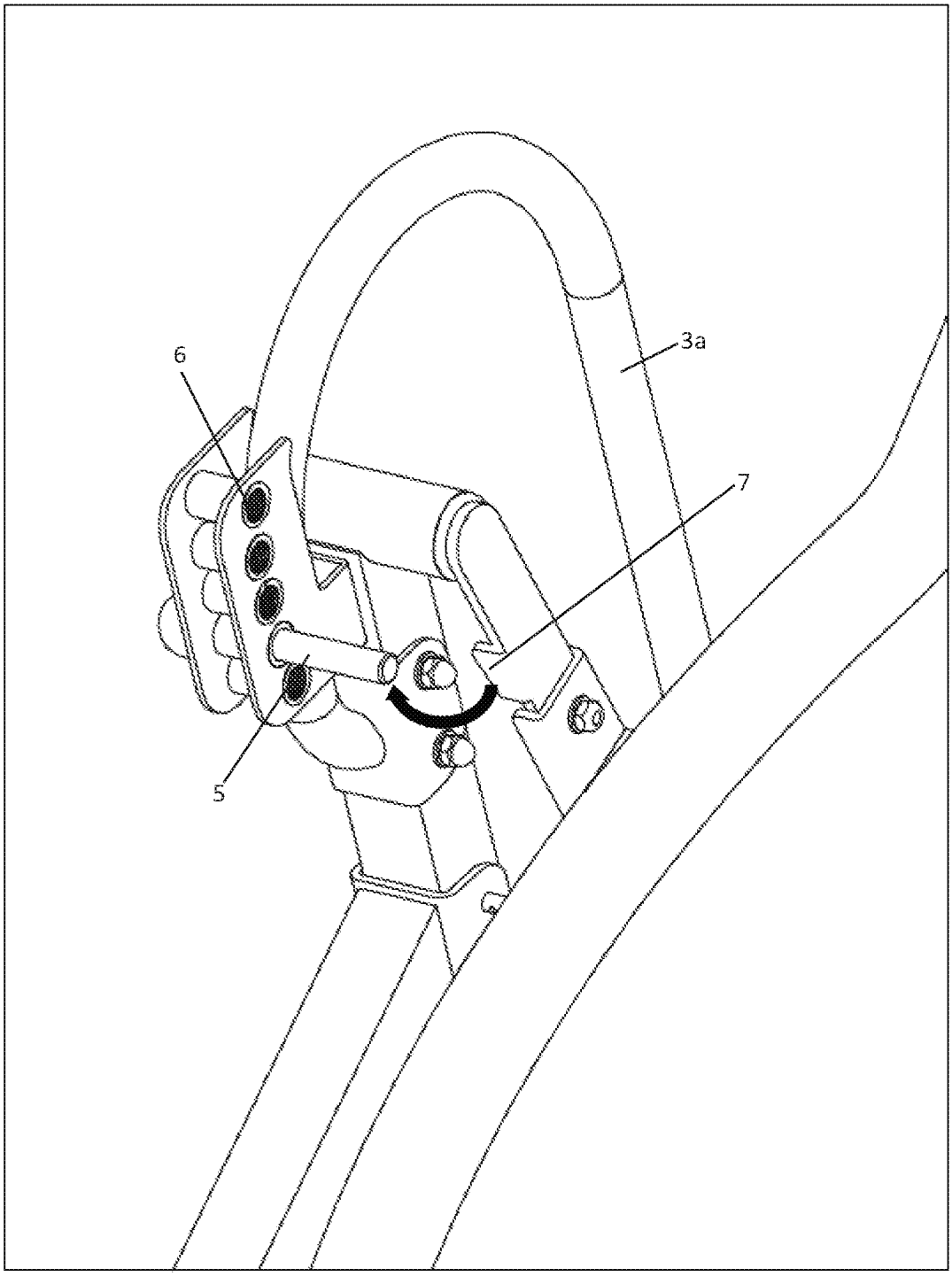
FIG. 2 provides a perspective view of a contact zone found on an inversion table having a pin and slot mechanism to set the maximum inversion angle.

With reference to FIG. 2, the pin (5) may be placed into a slot (6). The pin (5) may be held in a slot (6) such as by threads on the pin (5) and slot (6). Multiple slots (6) may be provided in order to allow different maximum inversion angles. The shape of the pin (5) and slot (6) shown are circular. However, it is understood that various pin (5) and slot (6) shapes may be used, such as ovular or rectangular. The rotatable surface (2) includes an arm (7) that makes contact with the pin (5) as the user is inverting. Such contact stops any farther rotation of the rotatable surface (2) thereby setting the maximum inversion angle. The area between the arm (7) of the rotatable surface and pin (5) forms a contact zone. The cover of the present invention is designed to surround that contact zone at least in part.

Figure 3A:
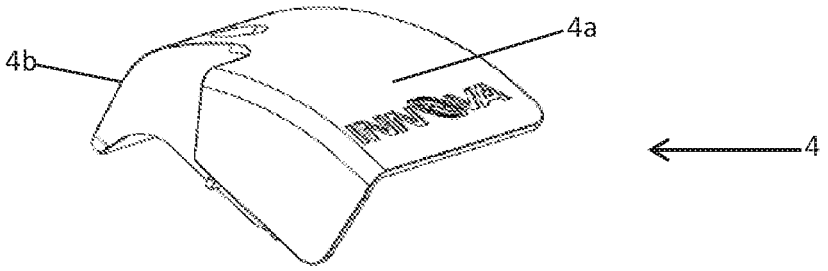
FIG. 3A provides a perspective view of the protective cover depicted in FIG. 1. (2 sided embodiment)
Figure 3B:
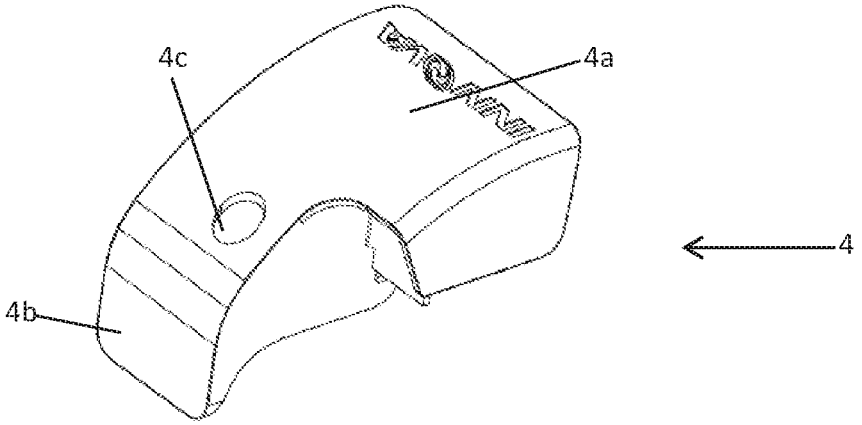
FIG. 3B provides another perspective view of the protective cover depicted in FIG. 1.
Figure 3C:
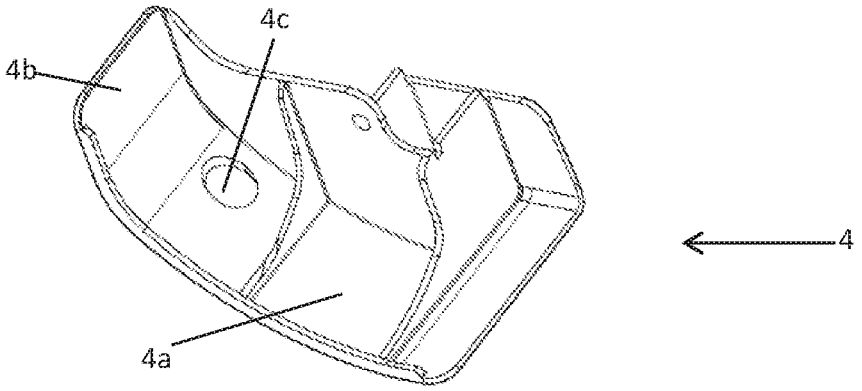
FIG. 3C provides another perspective view of the protective cover depicted in FIG. 1.

With reference to FIG. 3A, FIG. 3B, and FIG. 3C, a cover (4) having a top portion (4*a*) and a front portion (4*b*) is shown. The top portion (4*a*) has two ends and the front portion (4*b*) has two ends. One end of the top portion (4*a*) is connected to one end of the front portion (4*b*). As shown, the connection between the top portion (4*a*) and front portion (4*b*) may include a curved region. The connection may also be continuous such that it does not have any holes or gaps. The cover (4) may also include an opening (4*c*) that is sized to hold the pin (5) as a place to store the pin (5) in the event the pin (5) is removed from any slot (6).

When installed on an inversion therapy table (1) that is set up for a user, the top portion (4*a*) of the cover (4) is generally located above the contact zone. The front portion (4*b*) is generally located between contact zone and the backrest (2*a*) of the rotatable surface (2) such that the front portion (4*b*) is parallel longitudinal axis of the pin (5).

Figure 4:
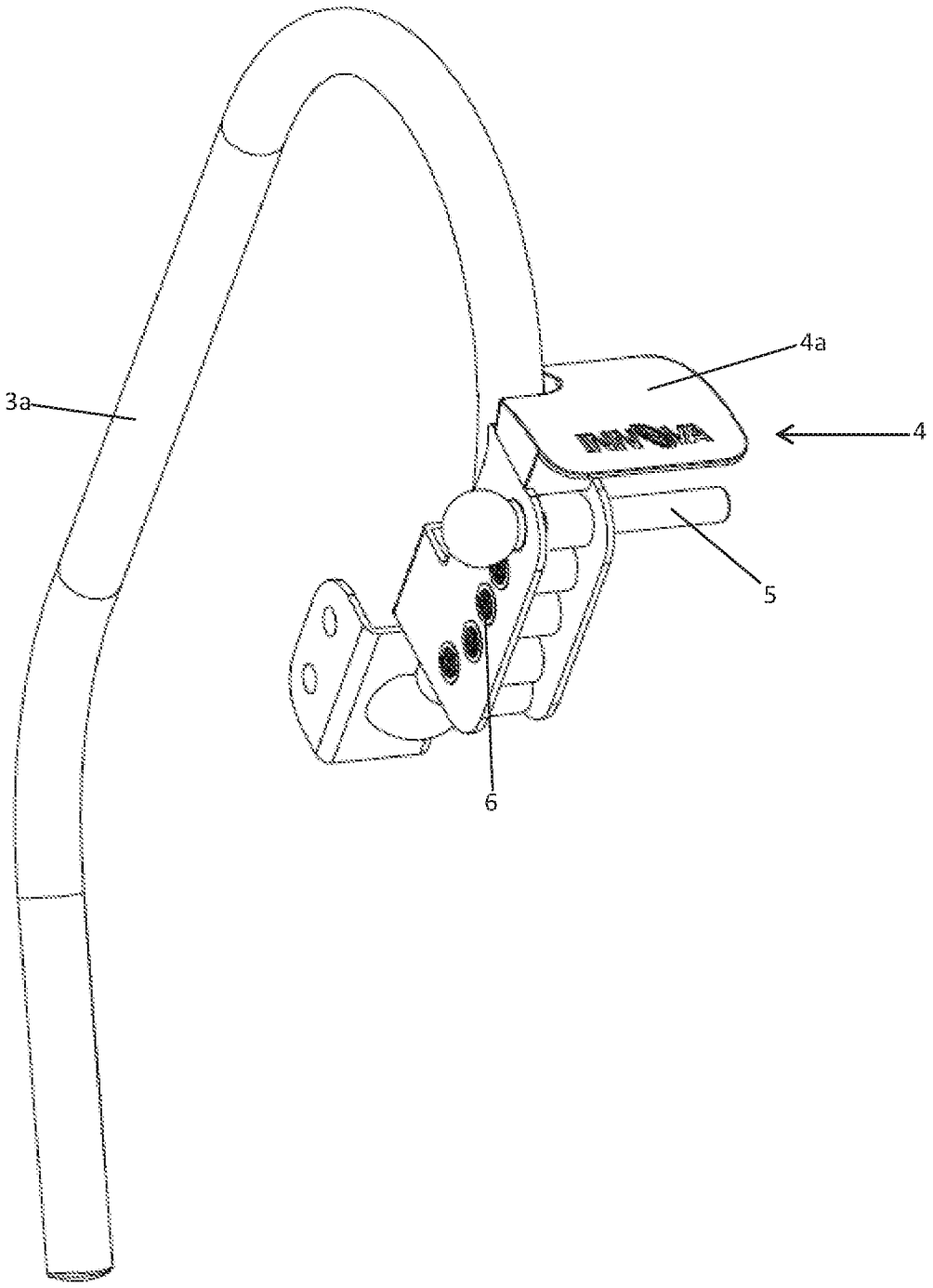
FIG. 4 provides a closer perspective view of the cover depicted in FIG. 3A, FIG. 3B, and FIG. 3C attached to the inversion table depicted in FIG. 1.

FIG. 4 shows the cover (4) attached to the pin (5) and slot (6) mechanism, which in turn is located near a handle (3*a*) of the base (3) of the inversion therapy table (1).

Figure 5A:
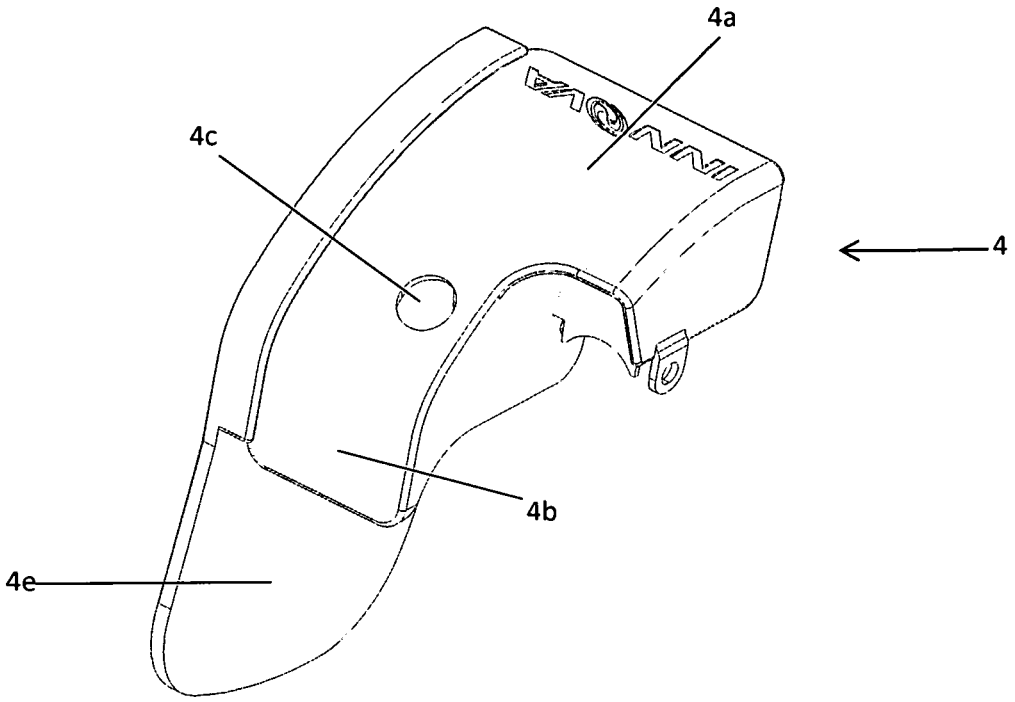
FIG. 5A provides a perspective view of a further embodiment of a protective cover. (3 sided embodiment)
Figure 5B:
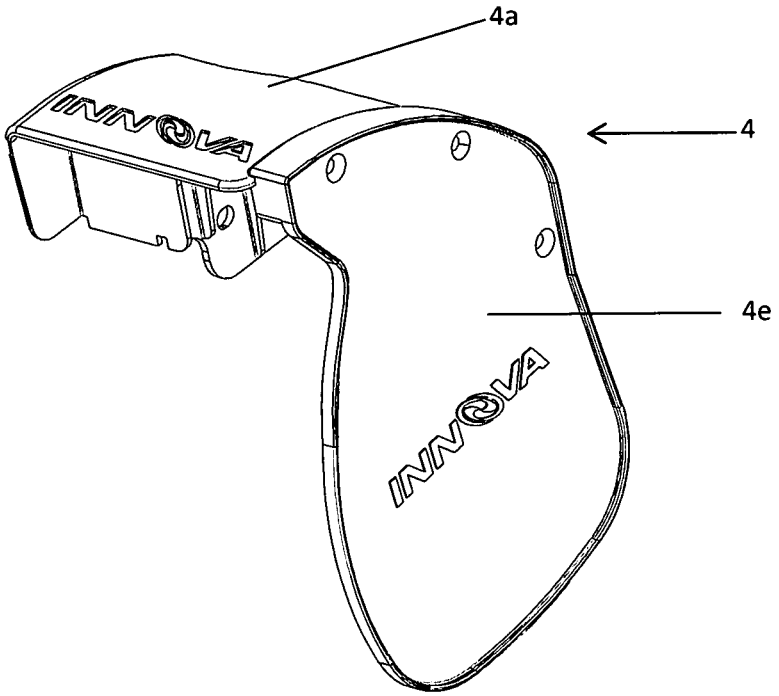
FIG. 5B provides another perspective view of a further embodiment of a protective cover.

FIG. 5A and FIG. 5B show a cover (4) that includes a lateral portion (4*e*) that is generally located between the contact zone and the longitudinal axis of the backrest (2*a*) and perpendicular to the longitudinal axis of the pin (5). The lateral portion (4*e*) has a top end that connects to a side edge of the top portion (4*a*), and the lateral portion (4*e*) has a side end that connects to a side edge of the front portion (4*b*). In this manner, the cover (4) generally surrounds the top, front, and a side of the contact zone.

Although not depicted, the cover (4) may further include a back portion that is generally located parallel to the front portion (4*b*) and on the opposite side of the contact zone as the front portion (4*b*). The back portion has a top end that connects to an end of the top portion (4*a*), and the back portion has a side end that connects to a side end of the lateral portion (4*e*). In this manner, the cover (4) generally surrounds the top, front, back, and a side of the contact zone.

The top portion (4*a*), front portion (4*b*), lateral portion (4*e*), and back portion may be connected to each other by various commonly known ways. These portions may be manufactured as one original piece, such as by injection molding. These portions may be manufactured as more than one original piece and then attached together, such as by screws, bolts, adhesive or heat.

Figure 6:
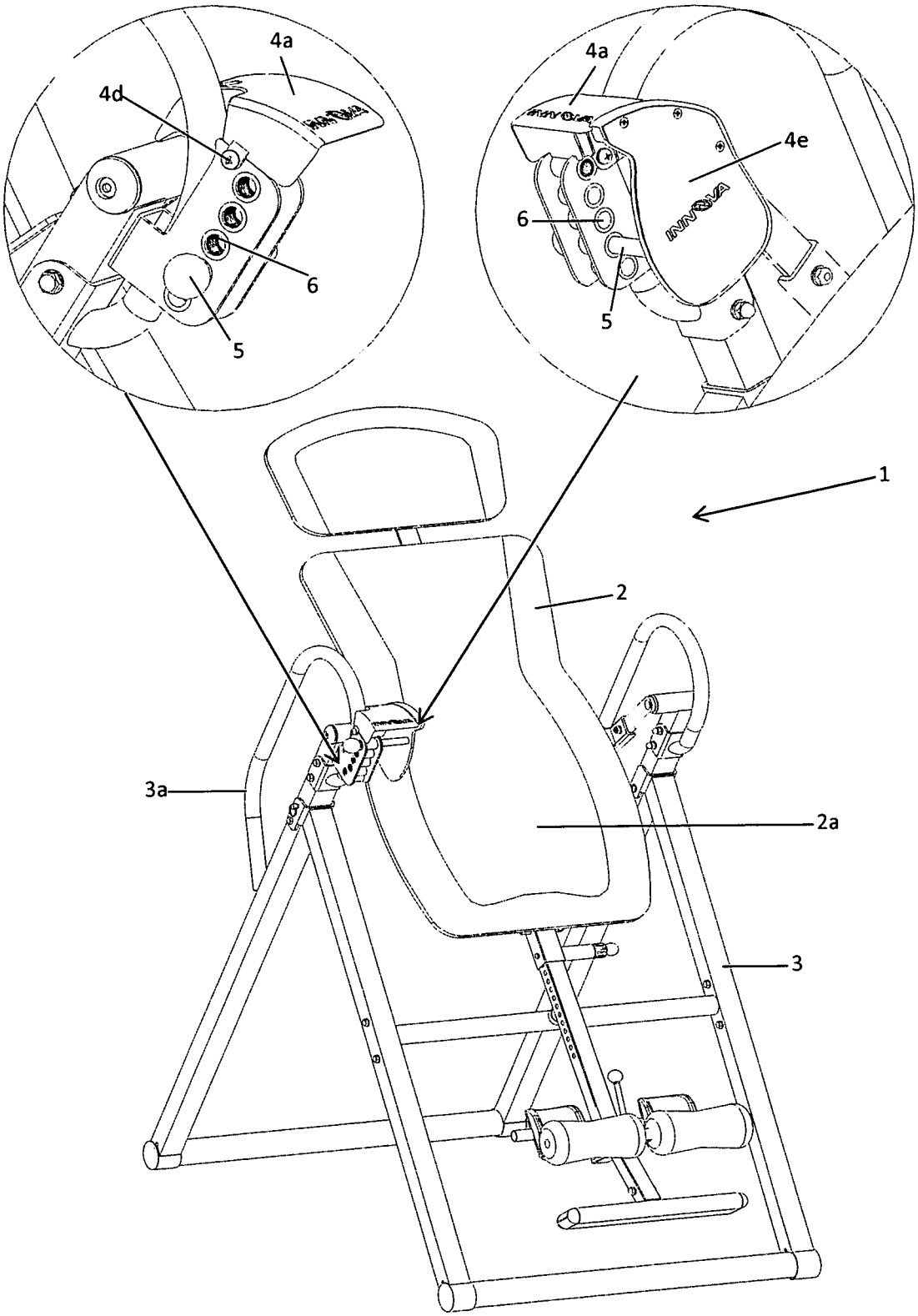
FIG. 6 provides a perspective view of an inversion therapy table having the cover depicted in FIG. 5A and FIG. 5B.

FIG. 6 shows the cover (4) of FIG. 5A and FIG. 5B attached to an inversion therapy table (1). The cover (4) includes a tab (4*d*) with an opening through which a screw is used to attach the cover (4) to the inversion table (1). The tab (4*d*) may be located in various locations on the cover (4) so long as it may be attached to the inversion therapy table (1). Other various commonly known ways may be used to attach the cover (4) to the inversion therapy table (1).

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the disclosed subject matter. Accordingly, the protection sought herein is as set forth in the claims below.

What is claimed is:

1. An inversion therapy table having a pin and a circular slot mechanism, wherein the pin contacts an arm to limit the angle of inversion comprising a base having a stop;

a rotatable surface rotatably connected to the base;

a contact zone between the rotatable surface and the stop;

a cover for the contact zone, the cover comprising:

a top portion having a first end and a second end; and a front portion having a first end and a second end, the first end of the front portion being connected to the first end of the top portion.

2. The inversion therapy table of claim 1, wherein the top portion includes a side edge;

the front portion includes a side edge; and the cover further comprising a lateral portion having a top end and a first side edge, the top end of the lateral portion being connected to the side edge of the top portion and the first side edge of the lateral portion being connected to the side edge of the front portion.

3. The inversion therapy table of claim 1, further comprising a tab having an opening.

4. The inversion therapy table of claim 1, wherein the stop is the pin having a diameter; and the top portion includes an opening having a diameter larger than the diameter of the pin.

5. The inversion therapy table of claim 1, wherein the stop is the pin having a diameter; and the front portion includes an opening having a diameter larger than the diameter of the pin.

* * * * *